United States Patent [19]

Guéret

[11] Patent Number: 4,617,948

[45] Date of Patent: Oct. 21, 1986

[54] MAKE-UP UNIT, FOR EYELASHES IN PARTICULAR

[75] Inventor: Jean-Louis H. Guéret, Paris, France

[73] Assignee: L'Oreal, Paris, France

[21] Appl. No.: 511,202

[22] Filed: Jul. 6, 1983

[30] Foreign Application Priority Data

Jul. 7, 1982 [FR] France ..... 8211922
Jun. 27, 1983 [FR] France ..... 8310565

[51] Int. Cl.[4] ..... A45D 40/30
[52] U.S. Cl. ..... 132/88.5
[58] Field of Search ..... 132/88.5, 88.7; 401/122

[56] References Cited

U.S. PATENT DOCUMENTS

| | | | |
|---|---|---|---|
| 3,084,374 | 4/1963 | Ziegler | 401/122 |
| 3,195,545 | 7/1965 | Lederberg et al. | 401/122 |
| 3,262,461 | 7/1966 | Kambersky | 401/122 |
| 3,662,769 | 5/1972 | Vasas | 132/88.7 |
| 3,817,637 | 6/1974 | Vasas | 401/122 |
| 3,861,810 | 1/1975 | Vasas | 401/122 |
| 3,896,823 | 7/1975 | Spatz | 132/88.7 |
| 4,332,494 | 6/1982 | Kingsford | 401/5 |

FOREIGN PATENT DOCUMENTS

| | | |
|---|---|---|
| 0002301 | 6/1979 | European Pat. Off. . |
| 2032815 | 11/1970 | France . |
| 1221919 | 5/1969 | United Kingdom . |

*Primary Examiner*—Gregory E. McNeill
*Attorney, Agent, or Firm*—Cushman, Darby & Cushman

[57] ABSTRACT

A make-up unit for storing mascara to be applied to eyelashes with a brush forming part of the unit includes a wiper device made of elastomeric material and having a pliable, elastically deformable lip which defines an opening whose diameter is distinctly smaller than the outer diameter of the brush and is slightly larger than the diameter of the core of the brush. The duct into which the brush is inserted during replacement into the reservoir of the make-up unit has, in its zone adjacent to the wiper device, a diameter which is greater than the diameter of a stem carrying the brush by at most 33%. The brush is constituted by a core formed by folding a metal wire back on itself and then twisting this doubled wire to secure the radial bristles in a helical arrangement, the diameter of the resulting brush being about 3 mm, the wire having a diameter of from about 0.4 mm to about 0.45 mm, and the stem having a diameter of about 3 mm.

7 Claims, 4 Drawing Figures

MAKE-UP UNIT, FOR EYELASHES IN PARTICULAR

BACKGROUND OF THE INVENTION

The present invention relates to a make-up unit, more particularly intended for the making up of eyelashes by means of an eyelash-emphasizing product, also called mascara.

PRIOR ART

A conventional mascara applicator comprises a reservoir containing the mascara and a detachable cap which is intended to close the reservoir and which constitutes a handle to facilitate manipulation of a brush which is carried by the end of a stem which is integral with the cap. In the closing position of the reservoir, the stem and the brush which is associated with it are lowered into the reservoir. When the stem is being withdrawn from the reservoir, a certain quantity of mascara is drawn off onto the brush which may then be applied to the eyelashes.

A mascara brush of the conventional type comprises, most frequently, tufts of relatively long bristles arranged in a spiral around a core formed by a metal wire. Generally, the core is formed by folding the metal wire back on itself, then by twisting this wire so as to secure in position the radial bristles in a helical arrangement.

The brush generally penetrates inside the reservoir via a substantially circular opening edged by a soft lip whose function is to exert a wiping action on the bristles of the brush with a view to eliminating the excess of the make-up product taken up by the brush within the reservoir. The diameter of this circular opening must be smaller than the minimum diameter of the brush measured at the tip of the bristles so that the pliable lip which borders the opening may exert a wiping action on the brush when the latter is withdrawn from the reservoir. At the same time, the wiper lip ensures the wiping of the part of the stem which penetrates into the make-up substance of the assumption that the stem has a diameter at least equal to the external diameter of the brush.

Moreover, the wiper device is disposed between the reservoir and a wiper holder fixed to the reservoir, the said wiper holder having a frustoconically shaped insertion duct. This cone frustum is necessary because the user must not be forced to aim at a small hole when reintroducing the brush carrier stem into the reservoir after use of the mascara and, moreover, because it is necessary to prevent the brush from touching the top edge of the brush carrier as it is being reintroduced into the reservoir, otherwise this top edge would progressively clog up.

To form a mascara brush, it has so far been usual to use a metal wire having a diameter of the order of 0.75 mm. Since, moreover, the length of the bristles must be sufficient to allow a proper separation of the eyelashes during make-up and hence a fine and regular makeup, mascara brushes usually have a diameter of at least 5 mm. It follows therefrom that the eyelash make-up units equipped with brushes of this type have a certain bulk which does not always make them easily transportable in a handbag.

If, in order to obtain a make-up unit of very small dimensions, it is acceptable for the size of the reservoir to be reduced, the resulting mascara applicator has its brush occupying practically the whole width of the reservoir and therefore has a certain number of disadvantages; firstly the space occupied by the brush and by the stem—which must have a sufficiently large diameter because of the bulk of the brush core—reduces the useful volume of the reservoir correspondingly so that the utilisation period of the make-up unit is very short; secondly, the displacement of the brush and of the stem within the reservoir creates a considerable piston effect which complicates the operations of the mascara take up and of the reintroduction of the brush inside the reservoir.

Moreover, the conventional brushes are not ideally suited to the application of mascara to short eyelashes or to the lashes situated on the lower eyelid. In fact, these brushes have a length of at least 2 cm so that during making up, the short eyelashes are masked from view by the brush which detracts from the accuracy of the application.

Moreover, in the conventional brushes, the pitch of the helical bristle arrangement is relatively great, of the order of 2 mm, which is not ideal for separating the eyelashes precisely and regularly for mascara application.

OBJECTS OF THE INVENTION

The present invention aims to overcome the above-mentioned disadvantages and proposes, for this purpose, a make-up unit fitted with a brush having a relatively small size without thereby making the bristles unduly short. It is known that if the brush bristles are too short, then on the one hand, the separation of the lashes cannot be effected and the make-up application is clumsy and, on the other hand, the wiping action is difficult because of the lack of suppleness of the brush, so the mascara applicator fitted with such a brush then becomes rapidly unusable. Moreover, the brush in accordance with the invention is one having a relatively small pitch in its helical arrangement of the bristles with a view to improving make-up application.

It is a further object of the invention to provide a make-up unit comprising a brush specifically adapted to the making up of short eyelashes, that is to say, apart from the characteristics indicated above, it has a length which is shorter than the lengths commonly used for mascara brushes, which is a necessary condition for obtaining good accuracy in making up short eyelashes.

The present invention also aims to provide an applicator of reduced size which can therefore be easily carried in a handbag without thereby limiting the capacity of the mascara reservoir and hence the durability of the make-up unit.

The present invention thus proposes a very small brush which is, however, rather fragile to the extent that it is made from a small diameter metal wire; moreover, it has a small core diameter which poses problems for the correct performance of the wiping action. Since the wiping of the brush must allow the wiper lips to penetrate as far as the vicinity of the brush core, it must follow that the diameter of the wiper opening should be considerably smaller than the outer diameter of the brush and hence also much smaller than the diameter of the stem. It follows that the wiper cannot be made of polyethylene, the material which is generally used for this purpose, because polyethylene does not have the requisite adequate suppleness.

It has, moreover, been found that if the opening of the frustoconical insertion duct situated near the wiper lip has a diameter which is relatively greater than that of the stem (exceeding, for instance, the stem diameter by more than 1.5 mm), the stem can, while it is being reintroduced into the reservoir, assume a position within the conical insertion duct which is sloping in relation to the reservoir axis; the brush then comes into contact with the inner wall of the reservoir and, because of its fragility is subjected to deformation of its core, the brush axis thus forming an angle in relation to that of the stem; it also follows that, in view of the suppleness of the material which has been adopted to form the wiper lip, the circular opening defined by the said wiper lip is elastically given an oval shape. In these conditions, the spoiled brush cannot, on the one hand, ensure correct application of make-up because the user must try to reposition it coaxial with the stem axis and on the other hand, the wiping only continues on one side of the wiper lip.

The present invention aims to overcome these drawbacks which can also occur at least partially in the case of brushes having dimensions approximating to the conventional dimensions for such brushes.

SUMMARY OF THE INVENTION

According to the invention, the wiper lip is made from an elastomer which allows the difference in diameter between the brush core and the outer surface of the stem to be absorbed. At the same time, to prevent the second drawback mentioned above, related both to the fragility of the brush and the choice of a relatively pliable elastomer material, the intended diameter of the lower zone of the insertion duct only allows a reduced play for the stem, thus preventing the wiper from assuming an oval shape whilst at the same time preventing the brush core from coming into contact with the inner wall of the reservoir.

Thus the present invention makes it possible to attain a twofold objective: on the one hand, to propose an eyelash make-up unit which is reduced in size and, on the other hand, to achieve with such a unit a suitable wiping action which leads to the deterioration neither of the brush nor of the wiper lip.

Thus the present invention is a new industrial product constituted by a make-up unit comprising a reservoir for a fluid or pasty make-up product, a detachable cap fitted on the reservoir, a stem integral with the cap disposed substantially along its axis and projecting in relation to the said cap and a brush carried by the steam in the extension of the stem, said brush being formed by an axial core carrying substantially radial bristles and having an outer diameter approximating to that of the stem, the brush penetrating inside the reservoir via a substantially circular opening edged by the lip of a wiper device, the said wiper device being disposed between the reservoir and a wiper holder fixed to the said reservoir, the said wiper holder having an insertion duct which has a frustoconical shape flaring towards the top and whose longitudinal axis is substantially identical with the axis of the opening through which the brush penetrates into the reservoir, characterised in that the wiper device is made of an elastomeric material and has a pliable, elastically deformable lip which defines an opening whose diameter is distinctly smaller than the outer diameter of the brush and is slightly larger than the diameter of the core of said brush, the diameter of the insertion duct in its zone adjacent to the wiper device exceeding the stem diameter by a third at most, the brush being constituted by a core formed by folding a metal wire back on itself and then twisting this thus doubled wire so as to secure the radial bristles in a helical arrangement, the diameter of the brush being about 3 mm, the metal wire being used having a diameter of from about 0.40 mm to about 0.45 mm, the stem then having a diameter of about 3 mm.

In accordance with a preferred embodiment of make-up unit, the wiper device is made of an elastomeric material having a SHORE hardness value of from about 45 to about 75. It has been found that with values higher than 75, the material is becoming too hard and is causing the brush passing through it to deteriorate. For values below 45, the material may be considered to be too pliable to effect correct wiping. Preferably, the wiper device is made of neoprene or nitrile rubber (Buna) with a SHORE hardness of about 55.

The diameter of the opening edged by the lip of the wiper device is preferably from about 1.5 mm to about 2.1 mm. For a brush, a stem and an opening edged by the wiper lip having the dimensions indicated above, it is preferable for the diameter of the insertion duct to be comprised in its zone adjacent to the wiper device from about 3.2 to about 4 mm. In this case, the diameter of the insertion duct in its zone furthest removed from the wiper device is advantageously from about 5.5 mm to about 6 mm, the axial length of said duct being of the order of 10 mm.

In accordance with an embodiment of the make-up unit, the wiper device for the brush is formed by an annular washer whose inner edge constitutes the wiper lip, the wiper holder being associated with means for keeping the said washer in position. Preferably, these means for keeping the washer in position are constituted by a retaining ring whose radial cross section forms an angle, one of the angle arms being perpendicular to the axis of the ring and corresponding to an annular flange whilst the other corresponds to a peripheral sleeve wherein the wiper holder comes to be inserted, a housing being arranged for the wiper device between the flange of the ring and the part of the wiper holder which is nearest to the reservoir.

Moreover, the wiper holder advantageously comprises a portion projecting in relation to the reservoir and carrying means complementary to the means carried by the cap to ensure the mounting of the cap on the reservoir.

In the case where the wiper device for the brush is formed by an annular washer having the structure indicated above, the said washer is held in position by the means also defined above and the wiper holder is of the type indicated above and advantageously comprises a tubular barrel whose cylindrical outer wall has a radial annular step approximately half way up, the cylindrical portion with the smaller diameter projecting from the reservoir and having an external thread intended to cooperate with a complementary internal thread of the cap, the cylindrical portion with the greater diameter being engaged with a tight fit in the peripheral sleeve of the retaining ring, the said retaining ring being force-fitted along the axis of the cylindrical container defining the reservoir until the flange of the retaining ring comes to abut against a step of the inner wall of the said container.

In accordance with another characteristic of the present invention, the wiper device has a frustoconical shape flaring towards the top.

In accordance with other characteristics of the brush of the make-up unit according to the invention, the pitch of the helical arrangement of the bristles is of the order of 1 mm; the brush has a length of from about 10 to about 20 mm; the reservoir and its cap are cylindrical and both have an external diameter of about 8 to 10 mm.

The small bulk of the stem and of the brush makes it possible to fill a container having a diameter of the order of 10 mm with mascara, whilst obtaining a long useful life for the applicator.

Moreover, the small dimensions of the brush render the make-up process very easy and precise, the user duly controlling the make-up operation in the mirror, the lashes not being hidden by an unduly large brush.

Moreover, because of using a metal wire with a diameter of from 0.40 to 0.45 mm, a sufficiently large bristle length is retained to impart to the brush the necessary suppleness for the making up operation and also for the wiping.

Moreover, the dimensions of the stem-brush unit and of the reservoir are such that the stem slides freely within the reservoir and may be withdrawn therefrom and may be introduced into it without splattering of the mascara.

BRIEF DESCRIPTION OF THE DRAWINGS

To render the object of the present invention more readily understood, there will be described below a mode of embodiment shown in the attached drawings by way of a purely illustrative and non-restrictive example.

In these drawings.

DETAILED DESCRIPTION OF A PRIOR ART EMBODIMENT

Figure 1:
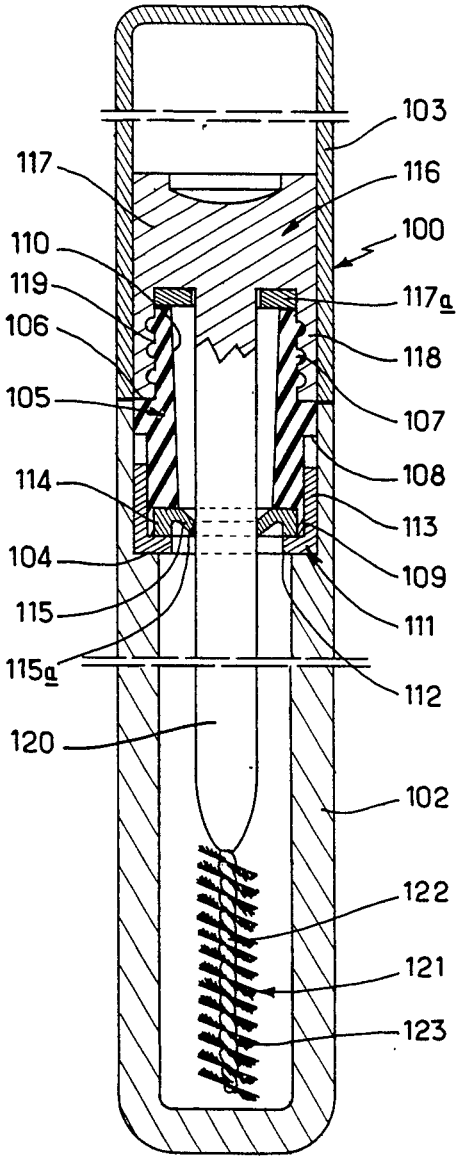
FIG. 1 is an axial cross section of a prior art type of make-up unit, showing the cap mounted on the reservoir.

Referring to FIG. 1 of the drawing, there will be seen a make-up unit 100, used in the conventional way for applying mascara to the eyelashes. In its closed position shown in FIG. 1 the unit 100 takes the form of a cylindrical stick whose lower part is formed by a cylindrical mascara reservoir 102 and whose upper part is formed by a cap 103 which is also cylindrical. In the closed position, the cylindrical wall of the cap 103 is located in the extension of that of reservoir 102.

The cylindrical inner wall of reservoir 102 has, near its top edge, a step providing an annular bearing seat 104 above which the wall of reservoir 102 has a smaller thickness.

At the opening of reservoir 102, there is fixed a wiper holder which has been generally designated by 105. The wiper holder 105 is formed by a tubular barrel having an external radial annular step 106 approximately half way up. The cylindrical portion having the smaller external diameter has an external thread 107 whose function is indicated below. The cylindrical portion of wiper-holder 105 having the greater external diameter has, near the radial annular step 106, a small annular step 108, below which this portion of the wiper holder 105 has a slightly reduced external diameter. This portion is extended at its base by a short skirt 109 whose function is indicated below.

The wiper holder 105 has a frustoconical inner wall defining the insertion duct 110 for the brush carrier rod described below. This insertion duct 110 has a continuous flare from the portion of the wiper holder 105 with the greater internal diameter towards its portion with the smaller internal diameter. Its longitudinal axis is substantially identical with the axis of the outer wall of the wiper holder 105.

With this wiper holder 105, there is associated a retaining ring 111 for the wiper device to be described below; the radial cross section of the retaining ring is at each side of the centre line of L-shape, one of the arms of the L being perpendicular to the axis of the ring 111 and corresponding to an annular flange 112 whilst the other arm of the L corresponds to a peripheral sleeve 113. The ring 111 is dimensioned so as to receive the lower portion of the wiper holder 105 with a tight fit and so as to be capable of being force fitted in the reservoir 102 along the axis thereof. The diameter of the portion of the wiper holder 105 between the annular steps 106 and 108 corresponds substantially to the inner diameter of the opening of reservoir 102 and the annular step 106 is disposed so as to be level with the edge of the reservoir 102 in the fitted position of the wiper holder 105 on the reservoir. The wiper holder 105 may consist of a metal component whilst the retaining ring 111 may advantageously be made of a plastic material.

The wiper device of the make-up unit shown carries reference number 114; it is formed by an annular washer whose inner edge constitutes a wiper lip 115, this latter having an upwardly flaring frustoconical shape defining at its free edge directed towards the bottom of the reservoir 102, an opening 115*a* through which the brush carrier stem penetrates into the reservoir 102. The wiper device 114 is made of neoprene or nitrile rubber (Buna) having a SHORE hardness of approximately 55.

The wiper holder 105 is assembled together with the wiper device 114 associated therewith in the following manner: The wiper device 114 is introduced into the inner space defined by the skirt 109 of wiper holder 105, this wiper device 114 abutting against the lower internal annular step of the said wiper holder 105. The retaining ring 111 is then engaged on the wiper holder 105 so that the peripheral sleeve 113 surrounds and grips the outer wall of skirt 109 and the flange 112 of the retaining ring 111 bears against the periphery of the wiper device 114. This sub-assembly is then introduced into the opening of reservoir 102 until the annular flange 112 abuts the annular bearing seat 104 of reservoir 102. In this position, the upper annular step 106 is level with the top edge of reservoir 102.

The cap 103 has, on its inside, a capsule 116 force-fitted inside the opening of the cap 103. This capsule 116 consists of a main body 117 having an outer cylindrical wall which is extended by an internally threaded shirt 118 which comes to bear against the inner wall near the opening of cap 103, the free edge of the said skirt 118 being level with that of cap 103. The internal thread 119 of the skirt is intended to cooperate with the outer thread 107 of the wiper holder 105.

Coaxially of the capsule 116 is a stem 120 which is integral with the capsule 116 and has a diameter of approximately 5 mm; the stem 120 projects outwardly from the cap 103; it terminates in a brush 121 which, in the closed position of the make-up unit, penetrates into the reservoir 102 such that the end of the brush 121 which is remote from that connected to the stem 120 arrives in position near the bottom of reservoir 102. It will be seen that the presentation cap 103 forms a handle allowing the brush 121 to be easily manipulated. An annular seal 117*a* is disposed against the annular wall of barrel 117 which is accessible from the opening of the cap 103.

The brush 121 is constituted by a core 122 which is disposed coaxially of the stem 120. The core 122 is formed by folding a metal wire back on itself, then twisting the thus doubled wire so as to secure around core 122 a helical arrangement of radial bristles 123. An iron wire with a standard diameter of 0.75 mm is used, and a brush of approximately 5 mm is obtained; the length of the bristles is of the order of 1.8 mm, and their radial measurement is of the order of 1.6 mm.

Moreover, the pitch of the helical arrangement of the bristles of brush 121 is 2 mm; moreover, the axial length of the brush is 2 cm.

This brush, with a 5 mm diameter, is the smallest brush which is acceptable for making up and which may be obtained with a metal wire of standard diameter for constituting its core.

Figure 2:
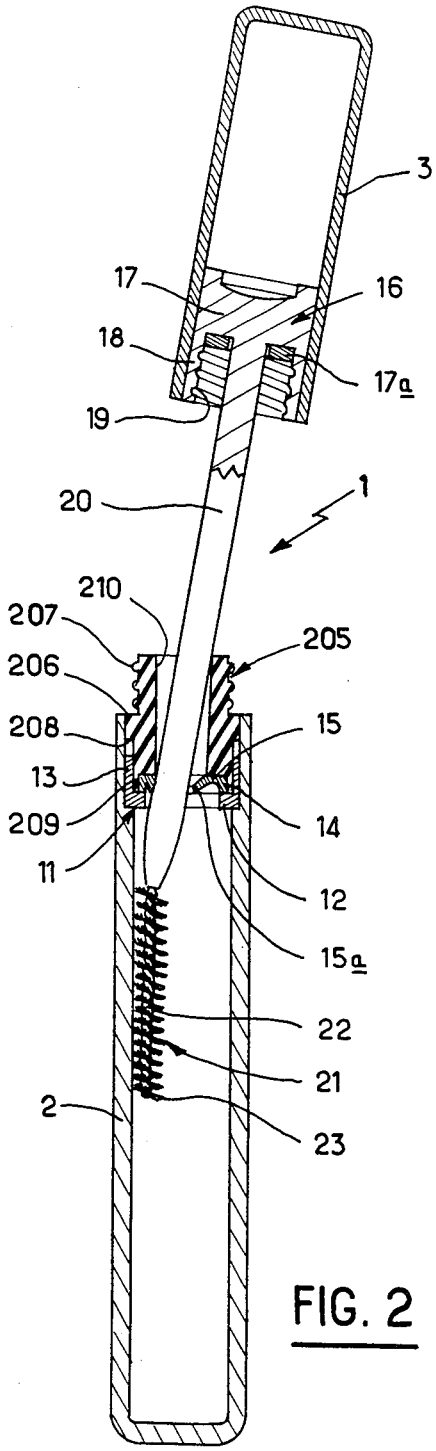
FIG. 2 is an axial cross sectional view of a make-up unit of a reduced dimension in relation to that of FIG. 1 but not corresponding entirely to the definition of the present invention, the brush carrier stem being shown in a position where it is partly inserted in the reservoir.

FIG. 2 shows a make-up unit of small dimensions which may therefore be easily carried in a handbag. This unit differs from the make-up unit according to the present invention only as regards its wiper holder. Except for the wiper holder and its component parts, (whose reference numbers have been increased by 100 in comparison with those used for the wiper holder of FIG. 1) the elements of this make-up unit 1 have been allocated reference numbers of those used for the unit shown in FIG. 1 but reduced by 100.

The brush 21, which therefore conforms to the present invention, has a core 22 made for a metal wire having a diameter of from 0.40 to 0.45 mm and the brush has a diameter of approximately 3 mm with a bristle length of the order of 1.1 mm and a radial measurement of the core 22 of the order of 1 mm.

If, in the known way, a metal wire of a standard diameter 0.75 mm is used, a brush having a 3 mm diameter would comprise bristles having a length of 0.75 mm. Such a brush would not be suitable for making up, since bristles of this length are far too short and impart stiffness to the brush, impair proper wiping and, moreover, do not allow the correct coating of mascara on the lashes. On the other hand, a bristle length of 1.1 mm remains perfectly correct, although it is slightly shorter than the normal bristle length for a brush having a 5 mm diameter made from a metal wire of standard diameter.

Moreover, the 1 mm pitch of the helical arrangement of bristles 23 of brush 21 in accordance with the invention is smaller than that of the brush of FIG. 1. The brush 21 of FIG. 2 has the additional advantage of a better separation of the eyelashes during making up.

Moreover, the brush 21 of FIG. 2 has a length of the order of 10 mm and hence is shorter than that of the brush of FIG. 1. This length of 10 mm is adequate, the small dimensions of brush 21 therefore making it possible to obtain a make-up action which is easy and precise, in particular for short eyelashes and also the eyelashes bordering the lower edge of the eye.

Stem 20 of make-up unit 1 has a diameter which is also of the order of 3 mm. It has been seen that the applicator of FIG. 1 must have a larger stem because the core of its brush is larger.

Had one been content to reduce merely the capacity of the reservoir, to obtain an eyelash make-up unit of small dimensions, there would have occurred a considerable piston effect in the reservoir, since the inner diameter of the reservoir would have been substantially equal to that of the brush. On the other hand, by making provision for a brush and a stem of small size, the brush carrier stem can be easily manipulated within the reservoir and one has a greater quantity of mascara available in comparison with a unit where the diameter of the reservoir had merely been reduced.

The wiper device 14 has a structure which is substantially identical to that of the wiper device 114, except that it is made of neoprene or nitrile rubber (Buna) having a SHORE hardness of approximately 55. The diameter of the opening edged by the wiper lip is of the order of 1.9 mm.

The wiper holder 205 of the make-up unit of FIG. 2, has its dimensions merely reduced whilst it retains the same proportions. The diameter of the insertion duct 210, in its zone which is furthest from the wiper device, is therefore very similar to the diameter of the insertion duct 210 in its zone adjacent to the wiper device 15, these dimensions being respectively 6 mm and 5 mm. In these circumstances, when the stem 20 is being inserted in the wiper holder 205, the stem may adopt a far more pronounced inclination in relation to the axis of reservoir 2, so that the brush 21 risks coming into contact with the wall of reservoir 2, producing on the one hand, a deflection of the core of brush 21 in relation to the direction of stem 20 and hence a deterioration of the said brush 21 and, on the other hand, an oval deformation of the pliable lip 15 edging opening 15*a*, the disadvantage of such an oval deformation being that in this case, the wiping is only effected on one side of brush 21. This incorrect position, which may be assumed by brush 21, has been illustrated in FIG. 2.

Figure 3:
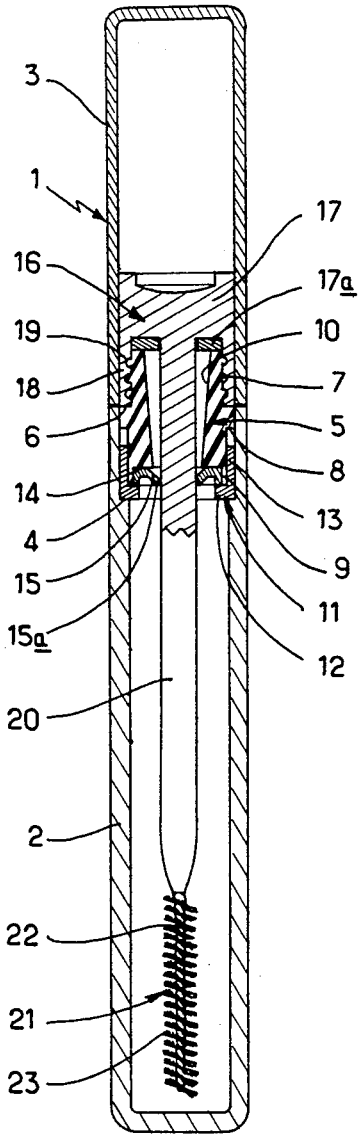
FIG. 3 is an axial cross sectional view of a make-up unit in accordance with the invention, the cap being mounted on the reservoir.
Figure 4:
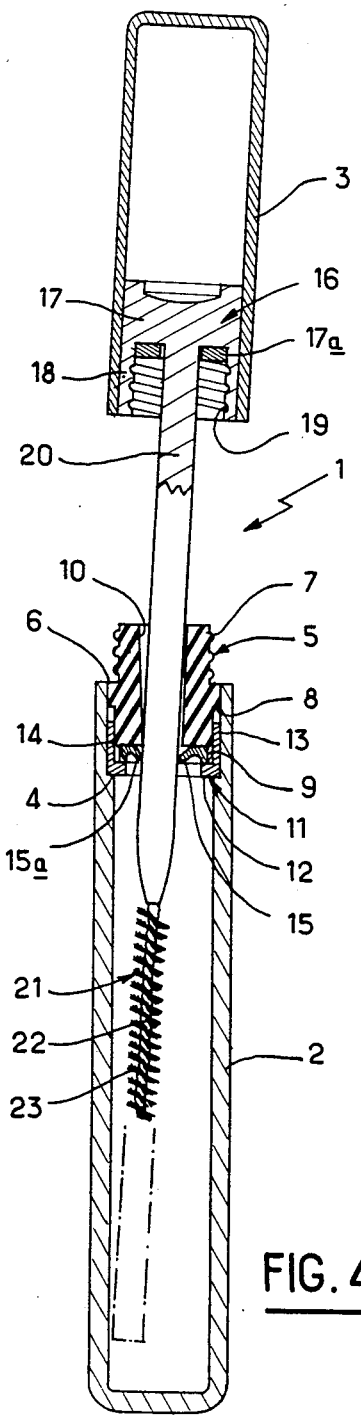
FIG. 4 is an axial cross sectional view of the make-up unit of FIG. 3, the brush carrier stem being shown in a position where it is partly inserted in the reservoir.

This disadvantage is overcome in the unit of FIGS. 3 and 4 which correspond entirely to the definition of the invention.

DETAILED DESCRIPTION OF THE PREFERRED EMBODIMENT

In the unit of FIGS. 3 and 4, the larger diameter of duct 10 is of the order of 5.5 mm and its smaller diameter is of the order of 4 mm; its axial length is of the order of 10 mm. Provision may, however, be made for the larger diameter of duct 10 to be of the order of 6 mm.

In these circumstances, knowing moreover that stem 20 and brush 21 have a diameter of 3 mm when the user introduces the brush carrier stem into the conical insertion duct 10 of wiper holder 5, the stem may assume a sloping position in relation to the axis of reservoir 2 which is such that brush 21 cannot come into contact with the inner wall of the reservoir 2. This sloping position has been illustrated in FIG. 4, showing in dash dot lines the extreme position which may be assumed by the brush in the case where the stem has been introduced at an angle into duct 10.

Moreover, since the opening 15*a* in the wiper lip and the core 22 of the brush 21 have a diameter of 1.9 mm and of 1 mm respectively, and since the lip 15 is relatively pliable, the wiper device can perform a perfect wiping action without the opening 15*a* being subject to an elastic oval deformation as a result of the sloping positions which may be assumed by stem 20 during its insertions into the reservoir 2 (because of the dimensions which have been chosen for duct 10, taking the diameter of stem 20 into account).

It will duly be seen that the size of the opening of duct 10 near the wiper device plays an important part in the functioning of the make-up unit.

Reservoir 2 and cap 3 both have an outer diameter of approximately 10 mm.

It shall be duly understood that the mode of embodiment described above is in no way restrictive and may give rise to any desirable modifications without thereby departing from the scope of the invention.

I claim:

1. A make-up unit comprising (a) a reservoir for a fluid or pasty make-up product, said reservoir comprising a container having an inner wall and a step formed integrally on said inner wall with a retainer ring seated on said step, said retainer ring having a wall portion engaging the inner wall of said container, said inner wall above said step having a thickness smaller than the thickness of the remainder of said inner wall;

(b) a detachable cap fitted on said reservoir;

(c) a stem integral with said cap and disposed substantially along the axis of said cap and projecting in relation to the said cap;

(d) a brush carried by the step in the extension of the stem, said brush comprising an axial core formed from a metal wire folded back on itself, the resulting doubled wire being twisted so as to provide a helical arrangement of substantially radial bristles, the diameter of said brush being about 3 mm, said metal wire having a diameter of from about 0.40 mm to about 0.45 mm and said stem having a diameter of about 3 mm; and (e) a wiper device having a lip bounding a substantially circular opening to receive said brush as it is inserted into said reservoir, the diameter of said opening being from about 1.5 mm to about 2.1 mm, said wiper device being disposed between the reservoir and a wiper holder fixed to said reservoir, said wiper holder engaging a portion of said retainer ring and having an insertion duct having an upwardly flaring frustoconical shape whose longitudinal axis is substantially identical with the axis of said circular opening through which said brush penetrates during insertion into said reservoir, the diameter of said insertion duct in the zone adjacent to said wiper device being from about 3.2 mm to about 4 mm, said wiper device being made of an elastomeric material and having said lip pliable and elastically deformable to define said circular opening with an external diameter which is clearly smaller than the outer diameter of said brush and is slightly greater than the diameter of the core of said brush.

2. The make-up unit of claim 1 wherein said wiper device is made of an elastomeric material having a Shore hardness value of from about 45 to about 75.

3. The make-up unit of claim 2 wherein said wiper device is made of neoprene or nitrile rubber (Buna) and has a Shore hardness of approximately 55.

4. The make-up unit of claim 1 wherein the diameter of the insertion duct at the zone furtherest removed from said wiper device is from about 5.5 mm to about 6 mm, the axial length of said insertion duct being about 10 mm.

5. The make-up unit of claim 1 wherein the helical arrangement of said bristles has a pitch of the order of 1 mm.

6. The make-up unit of claim 1 wherein said brush has a length of from about 10 mm to about 20 mm.

7. The make-up unit of claim 1 wherein said reservoir and said cap are cylindrical and both have an outer diameter of from about 8 mm to about 10 mm.

* * * * *